US011077483B2

(12) United States Patent
Simonson

(10) Patent No.: US 11,077,483 B2
(45) Date of Patent: Aug. 3, 2021

(54) APPARTUS AND METHOD FOR STEERING METAL PIPE DURING GROOVING PROCESS

(71) Applicant: Jon David Simonson, Alameda, CA (US)

(72) Inventor: Jon David Simonson, Alameda, CA (US)

( * ) Notice: Subject to any disclaimer, the term of this patent is extended or adjusted under 35 U.S.C. 154(b) by 360 days.

(21) Appl. No.: 16/169,136

(22) Filed: Oct. 24, 2018

(65) Prior Publication Data

US 2020/0130039 A1 Apr. 30, 2020

(51) Int. Cl.

| | |
|---|---|
| ***B21H 7/18*** | (2006.01) |
| ***B21D 7/02*** | (2006.01) |
| ***B21D 22/18*** | (2006.01) |
| ***B21D 17/04*** | (2006.01) |
| ***B21D 7/08*** | (2006.01) |
| ***B21D 7/022*** | (2006.01) |
| ***B21J 5/12*** | (2006.01) |

(52) U.S. Cl.

CPC ..... *B21H 7/18* (2013.01); *B21D 7/021* (2013.01); *B21D 7/022* (2013.01); *B21D 7/08* (2013.01); *B21D 17/04* (2013.01); *B21D 22/18* (2013.01); *B21J 5/12* (2013.01)

(58) Field of Classification Search

CPC ... B21H 7/18; B21H 7/182; B21J 9/00; B23G 1/22; B23G 1/24; B23G 1/52; B23B 13/126; B23B 13/12; B23B 47/00; B23Q 3/00; B25B 1/02; B25B 1/14; B25B 3/00; B25B 5/00; B25B 5/02; B25B 5/067; B25B 5/101; B21D 17/04

USPC .... 269/43, 3, 6, 95, 71, 166, 136, 228, 143, 269/248; 72/105, 106

See application file for complete search history.

(56) References Cited

U.S. PATENT DOCUMENTS

| | | | | |
|---|---|---|---|---|
| 2,004,540 | A * | 6/1935 | Smith | B23Q 7/04 414/560 |
| 3,095,772 | A * | 7/1963 | Ingwer | B23G 1/22 82/100 |
| 4,353,154 | A * | 10/1982 | Wagner | B23Q 37/00 144/48.3 |
| 5,778,715 | A * | 7/1998 | Lippka | B21D 41/023 72/106 |
| 10,022,801 | B1 * | 7/2018 | Devaney | B23B 5/08 |
| 2006/0230802 | A1 * | 10/2006 | Andre | B23D 21/04 72/71 |
| 2015/0090083 | A1 * | 4/2015 | Conrad | B23B 5/165 82/47 |

(Continued)

*Primary Examiner* — Shelley M Self
*Assistant Examiner* — Fred C Hammers
(74) *Attorney, Agent, or Firm* — Suiter Swantz pc llo

(57) ABSTRACT

An apparatus for steering a metal pipe during a roll grooving process including a clamp to be secured to a static structure of a grooving press spaced apart from a rotating cylinder of the grooving press, a pair of spaced parallel rods slidably disposed through spaced openings of the clamp, a handle affixed to first ends of the pair of spaced parallel rods distal from the rotating cylinder, and a guiding tool affixed to second ends of the pair of spaced parallel rods proximate to the rotating cylinder carrying spaced rollers adapted to contact an outer surface of a metal pipe during a roll grooving process to apply a force against the metal pipe. A method for applying a force against a metal pipe during a roll grooving process.

10 Claims, 3 Drawing Sheets

(56) References Cited

U.S. PATENT DOCUMENTS

2017/0151596 A1* 6/2017 Dole ..... B21D 17/04

* cited by examiner

APPARTUS AND METHOD FOR STEERING METAL PIPE DURING GROOVING PROCESS

TECHNICAL FIELD AND BACKGROUND OF THE INVENTION

The present invention relates generally to the field of grooving presses and methods for grooving metal pipe, and more particularly, to an apparatus for steering metal pipe during a grooving process to ensure application of a consistent annular groove while obviating the need for steering the metal pipe by hand.

Grooving presses are known for applying an annular groove around the outer surface of a length of metal pipe. Conventional grooving presses typically include a rotating cylinder and a grooving tool. One end of a length of metal pipe to be grooved is positioned between the rotating cylinder and the grooving tool such that the grooving tool is forced against the outer surface of the constrained metal pipe. As the rotating cylinder rotates, the metal pipe positioned in surrounding relation to the rotating cylinder consequently rotates, and a groove is applied thereto as a result of the force of the grooving tool against pipe.

The rotating cylinder typically has an outer diameter less than the inner diameter of the metal pipe to be grooved. Consequently, the loose-fitting engagement of the metal pipe against the rotating cylinder requires that the metal pipe be steered or turned during the grooving process to ensure constant turning and a consistent annular groove around the entire outer surface of the metal pipe.

Steering or turning is typically performed by hand by the operator. Specifically, as the rotating cylinder rotates, the operator manipulates the free end of the pipe by hand to keep the pipe turning to ensure a continuous and consistent groove depth around the pipe. Manipulating the pipe by hand positions the operators fingers close to the pinch point between the grooving tool and the metal pipe, which can result in serious injury such as finger loss if the operator is not careful, particularly when applying a groove to a short length of metal pipe.

Accordingly, what is needed is an apparatus and method of using the apparatus that ensures application of a consistent groove to a metal pipe, while obviating the need for manipulating the pipe by hand.

BRIEF SUMMARY OF THE INVENTION

In one embodiment, the inventive concepts disclosed herein are directed to an apparatus for steering a metal pipe during a roll grooving process including a clamp adapted to be secured to a static structure of a grooving press spaced apart from a rotating cylinder of the grooving press, the clamp comprising a pair of spaced openings, a pair of spaced parallel rods slidably disposed through the spaced openings of the clamp and coupled together for sliding movement relative to the clamp, a handle coupling the pair of spaced parallel rods secured to first ends of the pair of spaced parallel rods distal from the rotating cylinder, and a guiding tool coupling the pair of spaced parallel rods secured to second ends of the pair of spaced parallel rods proximate to the rotating cylinder, the guiding tool carrying spaced rollers adapted to contact an outer surface of a metal pipe during a roll grooving process to apply a force against the metal pipe.

In a further aspect, the clamp may include a central opening disposed between the pair of spaced openings, the central opening adapted to receive the static structure of the grooving press therethrough.

In a further aspect, the central opening may be axially perpendicular to the pair of spaced openings.

In a further aspect, the handle may couple the pair of spaced parallel rods together such that manipulating the handle slides the pair of spaced parallel rods together relative to the clamp.

In a further aspect, the handle may be generally C-shaped.

In a further aspect, the spaced rollers may be vertically-oriented roller bearings.

In another embodiment, the inventive concepts disclosed herein are directed to a method for steering a metal pipe during a roll grooving process including the steps of providing an apparatus including a clamp adapted to be secured to a static structure of a grooving press spaced apart from a rotating cylinder of the grooving press, the clamp comprising a pair of spaced openings, a pair of spaced parallel rods disposed through the spaced openings and coupled together for sliding movement relative to the clamp, a handle coupling the pair of spaced parallel rods secured to first ends of the pair of spaced parallel rods distal from the rotating cylinder, and a guiding tool coupling the pair of spaced parallel rods secured to second ends of the pair of spaced parallel rods proximate the rotating cylinder, the guiding tool carrying spaced rollers adapted to contact an outer surface of a metal pipe during a roll grooving process to apply a force against the metal pipe, securing the clamp to the static structure, and manipulating the handle to apply force on the spaced rollers against the metal pipe during the roll grooving process.

In a further aspect, the step of manipulating the handle may include pushing the handle in a direction of the metal pipe.

In a further aspect, the step of manipulating the handle may include pulling the handle in a direction away from the metal pipe.

In a further aspect, the clamp may include central opening disposed between the pair of spaced openings, the central opening adapted to receive the static structure of the grooving press therethrough.

In a further aspect, the central opening may be axially perpendicular to the pair of spaced openings.

In a further aspect, the handle may couple the pair of spaced parallel rods together such that manipulating the handle slides the pair of spaced parallel rods together relative to the clamp.

In a further aspect, the handle may be generally C-shaped.

In a further aspect, the spaced rollers may be vertically-oriented roller bearings.

Embodiments of the inventive concepts can include one or more or any combination of the above aspect, features and configurations.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated, and some features may be omitted or may be represented schematically in the interest of clarity. Like reference numerals in the drawings may represent and refer to the same or similar element, feature or function. In the drawings.

DETAILED DESCRIPTION OF EXEMPLARY EMBODIMENTS

The inventive concepts are described hereinafter with reference to the accompanying drawings in which exemplary embodiments are shown. However, the inventive concepts may be embodied in many different forms and should not be construed as limited to the representative embodiments set forth herein.

The inventive concepts disclosed herein are generally directed to an apparatus or tool for steering or guiding a metal pipe subject to a grooving process. The apparatus functions to steer the metal pipe by applying pressure thereto to ensure that the metal pipe is maintained in a desired position and/or in contact with a rotating cylinder of a grooving press during the grooving process. The apparatus obviates the need to manipulate the metal pipe by hand while ensuring the application of a consistent annular groove applied to the metal pipe.

Figure 1:
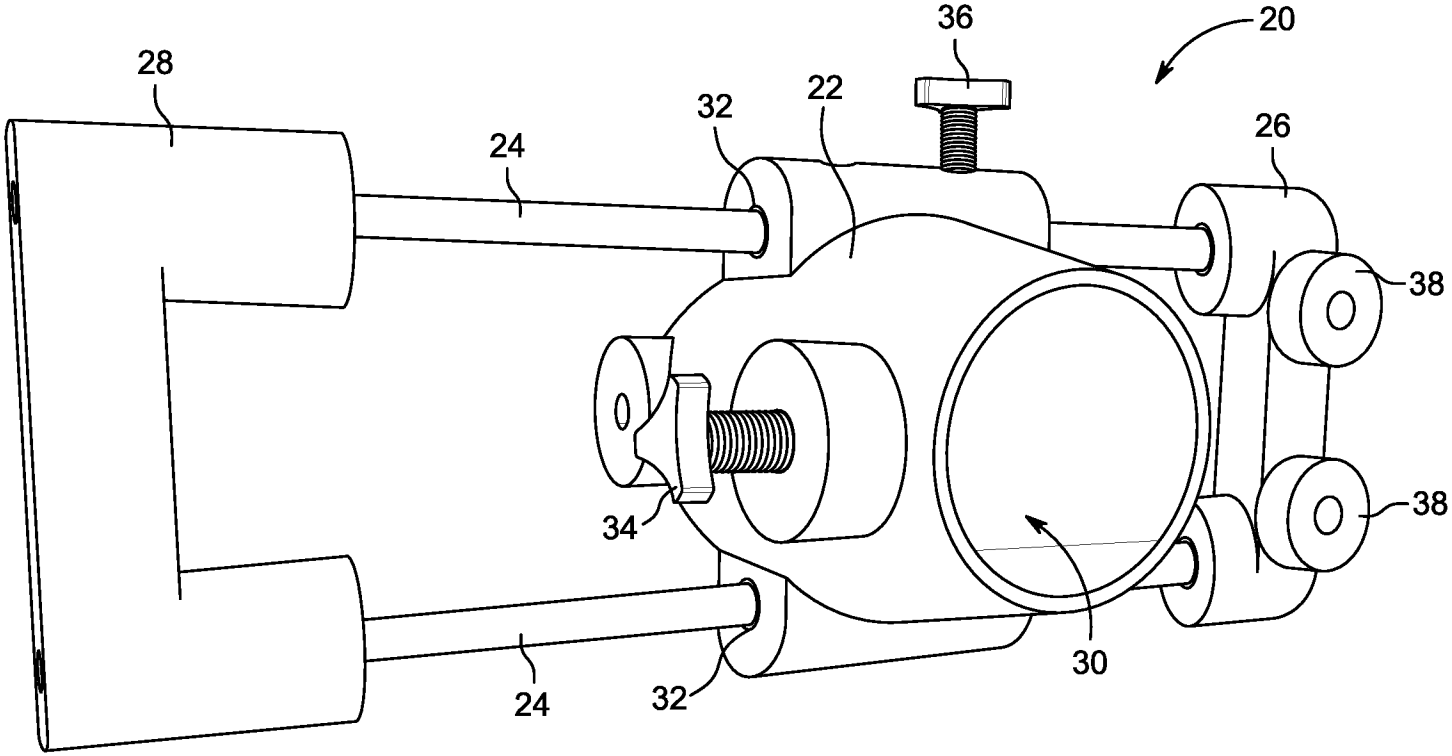
FIG. 1 is a perspective view of an apparatus for steering a metal pipe during a roll grooving process according to an embodiment of the invention.

FIG. 1 illustrates an apparatus for steering metal pipe according to an exemplary embodiment of the invention. The apparatus 20, also referred to herein as a "tool," generally includes a clamp 22, a pair of spaced parallel rods 24, a tool head 26, and a handle 28. The clamp 22, which in certain embodiments may be a collar, is configured to be secured along a length of a static element of a grooving press, spaced apart from a rotating cylinder of the grooving press. For example, the clamp may secure along the length of a static cylinder spaced apart and oriented generally axially parallel to the rotating cylinder. The clamp 22 includes a main or central opening 30 for receiving the static element therethrough, and a pair of rod openings 32 axially perpendicular to the central opening for slidably receiving the parallel rods 24 therethrough. As shown, the rod openings 32 are disposed along diametrically opposed sides of the central opening 30.

A first set screw 34 is received in a first internally-threaded opening of the clamp 22 and is turned to advance the first set screw into the opening and into engagement with the static element to set or "lock" the position of the clamp relative to the static element to prevent relative motion therebetween, (e.g., linear and rotational motion). A second set screw 36 is received in a second internally-threaded opening of the clamp 22 and is turned to advance the second set screw into the opening and into engagement with one of the parallel rods 24 to set or "lock" the position of the parallel rods relative to the clamp 22 to prevent relative motion therebetween (e.g., linear motion). As discussed in detail below, the parallel rods 24 are coupled through the tool head 26 and the handle 28 disposed at opposing ends of the rods. In this configuration, fixing the position of one rod relative to the clamp fixes the position of the other rod relative to the clamp. Each of the set screws 34, 36 may be turned by hand or configured to be turned with a tool to tighten or loosen the set screws to adjust the position of the clamp or rods.

The pair of spaced parallel rods 24 are slidably disposed through the spaced rod openings 32 and are coupled together for sliding movement relative to the clamp 22. The handle 28 is affixed to adjacent ends of the rods 24, thereby coupling the rods for sliding movement, and in use the handle is disposed distal from the rotating cylinder of the grooving press. The tool head 26 as shown is a guiding tool affixed to adjacent ends of the rods 24, thereby also coupling the rods for sliding movement. The tool head 26 carries spaced rollers 38 arranged to contact an outer surface of a metal pipe during a roll grooving process to steer the metal pipe by applying a force against the metal pipe by pushing on the handle 28. The rollers 38 may be vertically-oriented roller bearings mounted on fixed posts and are spaced apart to ensure two-point contact against the metal pipe while accommodating various diameters of pipe.

In non-limiting exemplary embodiments, the handled 28 may be C-shaped, and any one of the handle 28, tool head 26 and clamp 22 may be made from metal, plastic and combinations thereof. The handle 28 and tool head 26 may be affixed about the ends of the parallel rods 24 by interference fit, fasteners, overmolding, etc.

Figure 2:
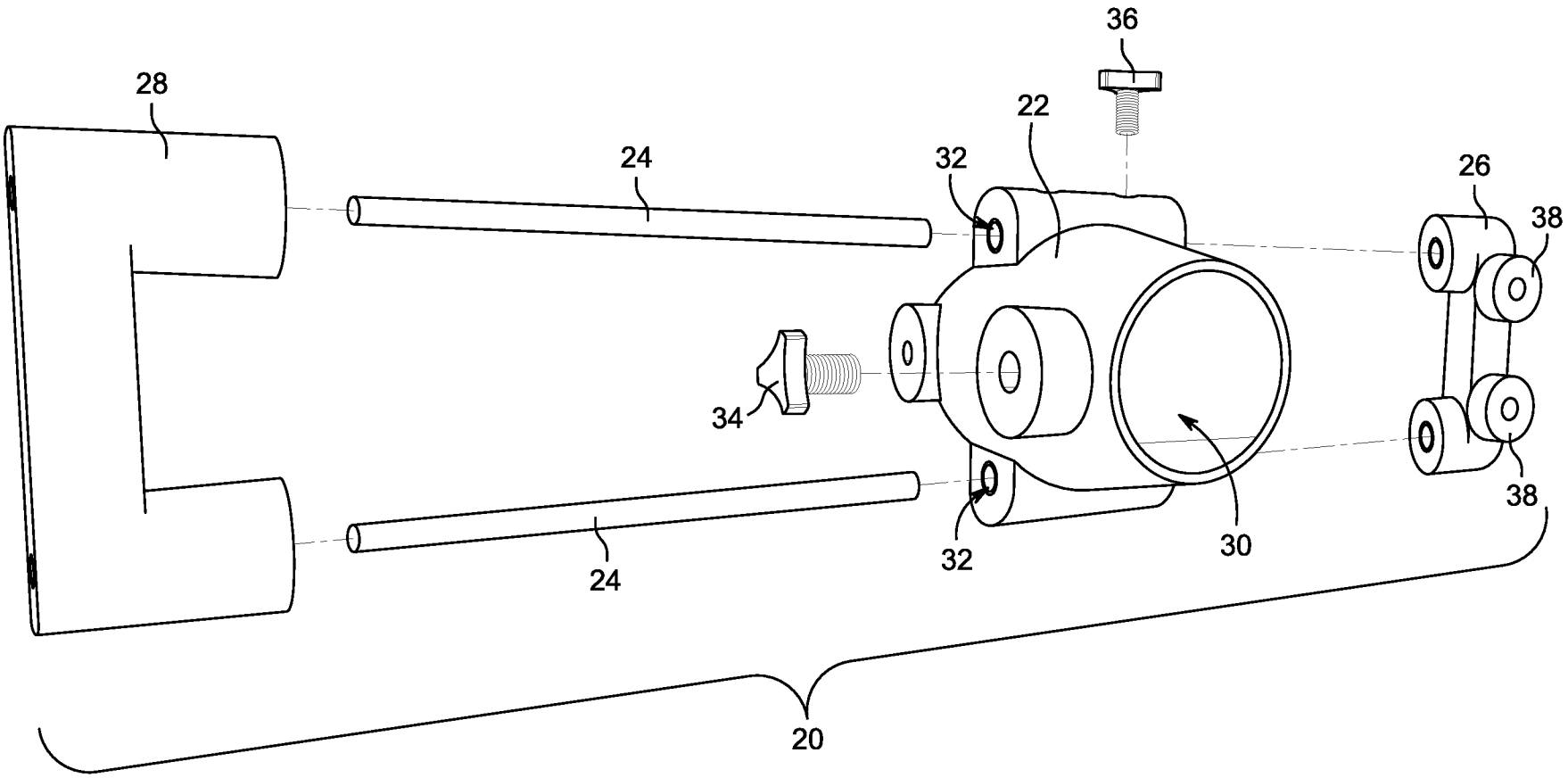
FIG. 2 is an exploded view of the apparatus of FIG. 1.

FIG. 2 is an exploded view of the apparatus 20 illustrating the above-discussed components.

Figure 3:
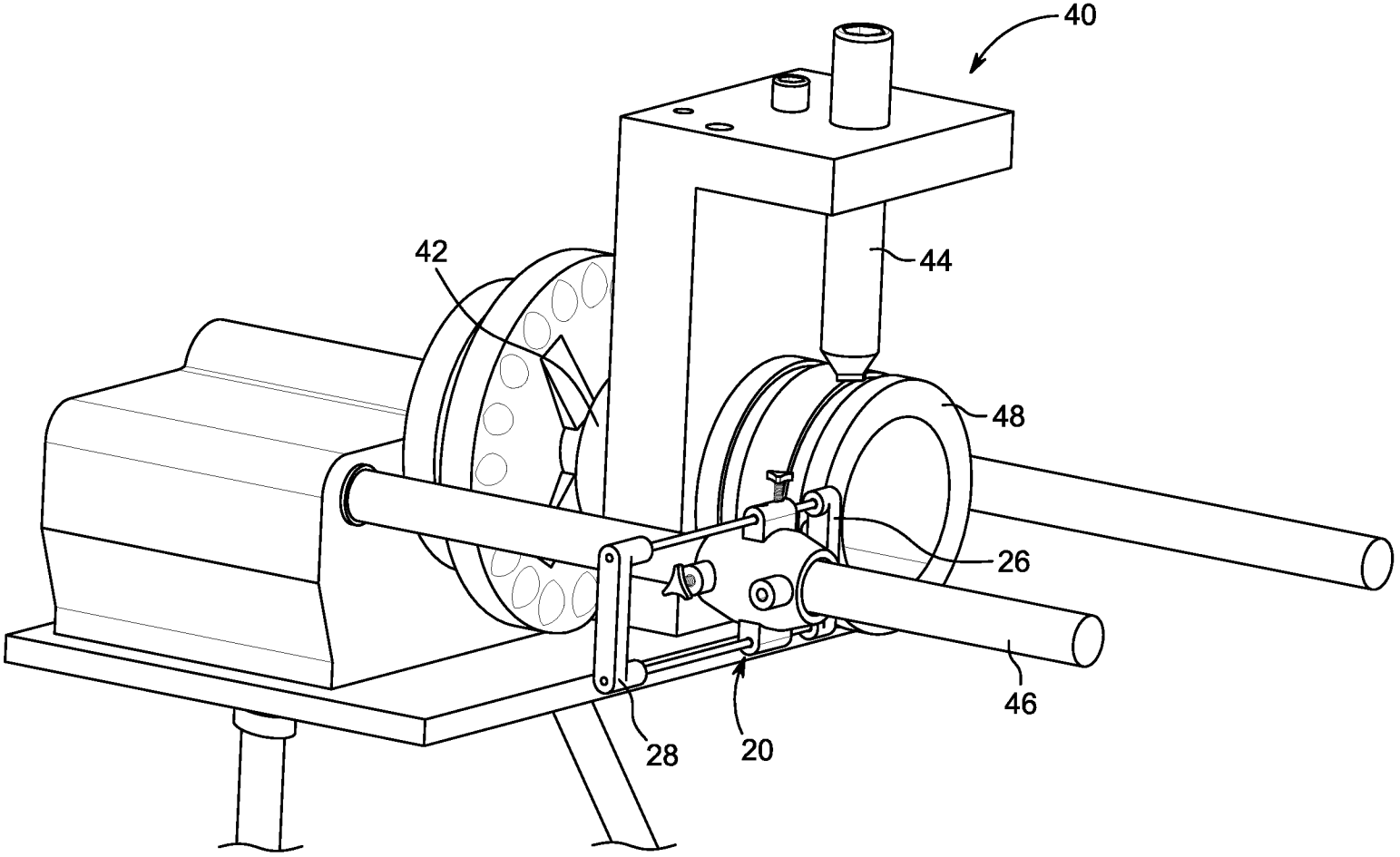
FIG. 3 is a schematic diagram illustrating a roll grooving press and apparatus according the present invention steering a metal pipe having a groove applied thereto.

FIG. 3 illustrates the apparatus 20 in use. In a non-limiting example, the grooving press 40 may generally include a driven rotating cylinder 42, a groove-forming tool 44 axially perpendicular to the rotating cylinder, and the static element 46 substantially axially parallel to the rotating cylinder. The static element 46 is spaced apart from the rotating cylinder 42 such that free space is provided between the static element and the rotating cylinder for positioning the tool head 26. The metal pipe 48 of a predetermined diameter is positioned in surrounding relation over the rotating cylinder 42. The rotating cylinder 42 turns, driven by a motor, rotating the metal pipe 48 therewith. The groove-forming tool 44 is forced against the outer surface of the metal pipe 48, for example, from continuous pressure applied by turning the tool, to form an annular groove in the outer surface of the metal pipe.

The relative position of the clamp 22 is set along the length of the static element 46 to position the tool head 26 with respect to the groove to be formed. Once the position of the clamp 22 is set, the first set screw 34 is tightened to lock the clamp in place. The handle 28 is then gripped and pushed in a direction of the metal pipe 48 to force the spaced rollers into contact with the outer surface of the metal pipe, thereby forcing the metal pipe against the underlying rotating cylinder 42 to ensure complete turning of the metal pipe to ensure application of a consistent annular groove. The position of the rods 24 relative to the clamp 22 may be locked, and adjustments during the process may be made.

While the foregoing description provides embodiments of the inventive concepts by way of example only, it is envisioned that other embodiments may perform similar functions and/or achieve similar results. Any and all such equivalent embodiments and examples are intended to be covered by the appended claims.

What is claimed is:

1. An apparatus for guiding metal pipe to a groover, comprising:

a clamp adapted to be secured to a static structure of a grooving press spaced apart from a rotating cylinder of the grooving press, the clamp comprising a pair of spaced openings and a central opening disposed between and axially perpendicular to the spaced openings, the central opening adapted to receive the static structure of the grooving press therethrough;

a pair of spaced parallel rods slidably disposed through the pair of spaced openings of the clamp and coupled together for sliding movement relative to the clamp;

a handle coupling the pair of spaced parallel rods, the handle fixed to first ends of the pair of spaced parallel rods distal from the rotating cylinder; and a guiding tool coupling the pair of spaced parallel rods, the guiding tool fixed to second ends of the pair of spaced parallel rods proximate to the rotating cylinder, the guiding tool carrying spaced rollers adapted to contact an outer surface of a metal pipe during a roll grooving process to apply a force against the metal pipe;

wherein the clamp is positioned between the handle and the guiding tool; and wherein the handle, the guiding tool, and the pair of spaced parallel rods are coupled together as a unit slidable relative to the clamp.

2. The apparatus according to claim 1, wherein the handle couples the pair of spaced parallel rods together such that manipulating the handle slides the pair of spaced parallel rods together relative to the clamp.

3. The apparatus according to claim 1, wherein the handle is generally C-shaped.

4. The apparatus according to claim 1, wherein the spaced rollers are vertically-oriented roller bearings.

5. A method for guiding metal pipe to a groover, comprising the steps of:

providing an apparatus comprising:

a clamp adapted to be secured to a static structure of a grooving press spaced apart from a rotating cylinder of the grooving press, the clamp comprising a pair of spaced openings and a central opening disposed between and axially perpendicular to the pair of spaced openings, the central opening adapted to receive the static structure therethrough;

a pair of spaced parallel rods slidably disposed through the spaced openings of the clamp and coupled together for sliding movement relative to the clamp;

a handle coupling the pair of spaced parallel rods, the handle fixed to first ends of the pair of spaced parallel rods distal from the rotating cylinder; and a guiding tool coupling the pair of spaced parallel rods, the guiding tool fixed to second ends of the pair of spaced parallel rods proximate the rotating cylinder, the guiding tool carrying spaced rollers adapted to contact an outer surface of a metal pipe during a roll grooving process to apply a force against the metal pipe;

wherein the clamp is positioned between the handle and the guiding tool; and wherein the handle, the guiding tool, and the pair of spaced parallel rods are coupled together as a unit slidable relative to the clamp;

securing the clamp to the static structure; and manipulating the handle to apply force on the spaced rollers against the metal pipe during the roll grooving process.

6. The method according to claim 5, wherein the step of manipulating the handle comprises pushing the handle in a direction of the metal pipe.

7. The method according to claim 5, wherein the step of manipulating the handle comprises pulling the handle in a direction away from the metal pipe.

8. The method according to claim 5, wherein the handle couples the pair of spaced parallel rods together such that manipulating the handle slides the pair of spaced parallel rods together relative to the clamp.

9. The method according to claim 5, wherein the handle is generally C-shaped.

10. The method according to claim 5, wherein the spaced rollers are vertically-oriented roller bearings.

* * * * *